US006343687B1

(12) United States Patent
Salvetti et al.

(10) Patent No.: US 6,343,687 B1
(45) Date of Patent: Feb. 5, 2002

(54) SOCK FEEDING DEVICE

(75) Inventors: Sergio Salvetti, Chiari; Renato Pandolfi, Gorle; Mario Valle, Pavia, all of (IT)

(73) Assignee: Conti Complett S.p.A., Milan (IT)

( * ) Notice: Subject to any disclaimer, the term of this patent is extended or adjusted under 35 U.S.C. 154(b) by 0 days.

(21) Appl. No.: 09/599,967

(22) Filed: Jun. 23, 2000

(30) Foreign Application Priority Data

Jun. 24, 1999 (IT) ..... MI99A1410

(51) Int. Cl.[7] ..... B65G 47/04
(52) U.S. Cl. ..... 198/470.1
(58) Field of Search ..... 198/470.1, 401

(56) References Cited

U.S. PATENT DOCUMENTS 4,602,710 A * 7/1986 Bell, Jr. et al. ..... 198/468.2
5,442,841 A * 8/1995 McLeod et al. ..... 198/222 X

FOREIGN PATENT DOCUMENTS

EP 0 508 014 10/1992
GB 984 197 2/1965
GB 1 660 980 5/1971
IT 1 293 751 3/1999

* cited by examiner

*Primary Examiner*—Joseph D. Pape
*Assistant Examiner*—Lori L. Coletta
(74) *Attorney, Agent, or Firm*—Guido Modiano; Albert Josif; Daniel O'Byrne

(57) ABSTRACT

A device for feeding correctly orientated socks to a processing station, comprising: a laying unit, which can be fed with a sock and is adapted to lay out the sock in a substantially horizontal direction; a conveyor, which is arranged below the laying unit and forms a substantially horizontal resting surface for the sock that falls from the laying unit after being laid out. The conveyor can be actuated in order to produce the advancement of the sock in a direction which is parallel to the longitudinal extension of the sock, with its toe directed in the advancement direction. The device further comprising a positioner, which is provided with grippers for gripping the sock at its toe as it arrives from the conveyor and can be actuated so as to arrange the sock so that it hangs vertically at its toe.

9 Claims, 5 Drawing Sheets

4
5
33a
33
34
35
32
40
30
36
37
22
20

SOCK FEEDING DEVICE

BACKGROUND OF THE INVENTION

The present invention relates to a device for feeding correctly orientated socks to a processing station.

It is known that the toe of socks is generally still open when said socks are unloaded from the machine that forms them, and that said socks must be subsequently subjected to darning or looping, which closes the toe, thus obtaining the finished product.

The socks that leave the machine that forms them are usually grouped and arranged in containers to be transferred to the machine that darns or loops the toe.

The darning or looping machine is loaded manually by an operator, who removes the socks from the transfer container and correctly places the toe of the socks on the machine.

The socks very often reach the operator assigned to loading the darning or looping machine in a disorderly arrangement; therefore the loading of said machine can entail times which inevitably do not allow to fully utilize the production potential of modern darning or looping machines and significantly affect the overall production costs of socks.

SUMMARY OF THE INVENTION

The aim of the present invention is to provide a device which can feed a processing station with socks which are correctly orientated, i.e., ready to be loaded onto the darning or looping machine so as to significantly reduce the time required by the loading operation.

Within the scope of this aim, an object of the invention is to provide a device which, by reducing the time required to load the socks onto the darning or looping machines, allows to fully utilize the production potential of said machines.

These and other objects which will become better apparent hereinafter are achieved by a device for feeding correctly orientated socks to a processing station, characterized in that it comprises: a laying unit, which can be fed with a sock and is adapted to lay out the sock in a substantially horizontal direction; a conveyor, which is arranged below said laying unit and forms a substantially horizontal resting surface for the sock that falls from said laying unit after being laid out and can be actuated in order to produce the advancement of the sock in a direction which is parallel to the longitudinal extension of the sock, with its toe directed in the advancement direction; and a positioner, which is provided with means for gripping the sock at its toe as it arrives from said conveyor and can be actuated so as to arrange the sock so that it hangs vertically at its toe.

BRIEF DESCRIPTION OF THE DRAWINGS

Further characteristics and advantages of the present invention will become better apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
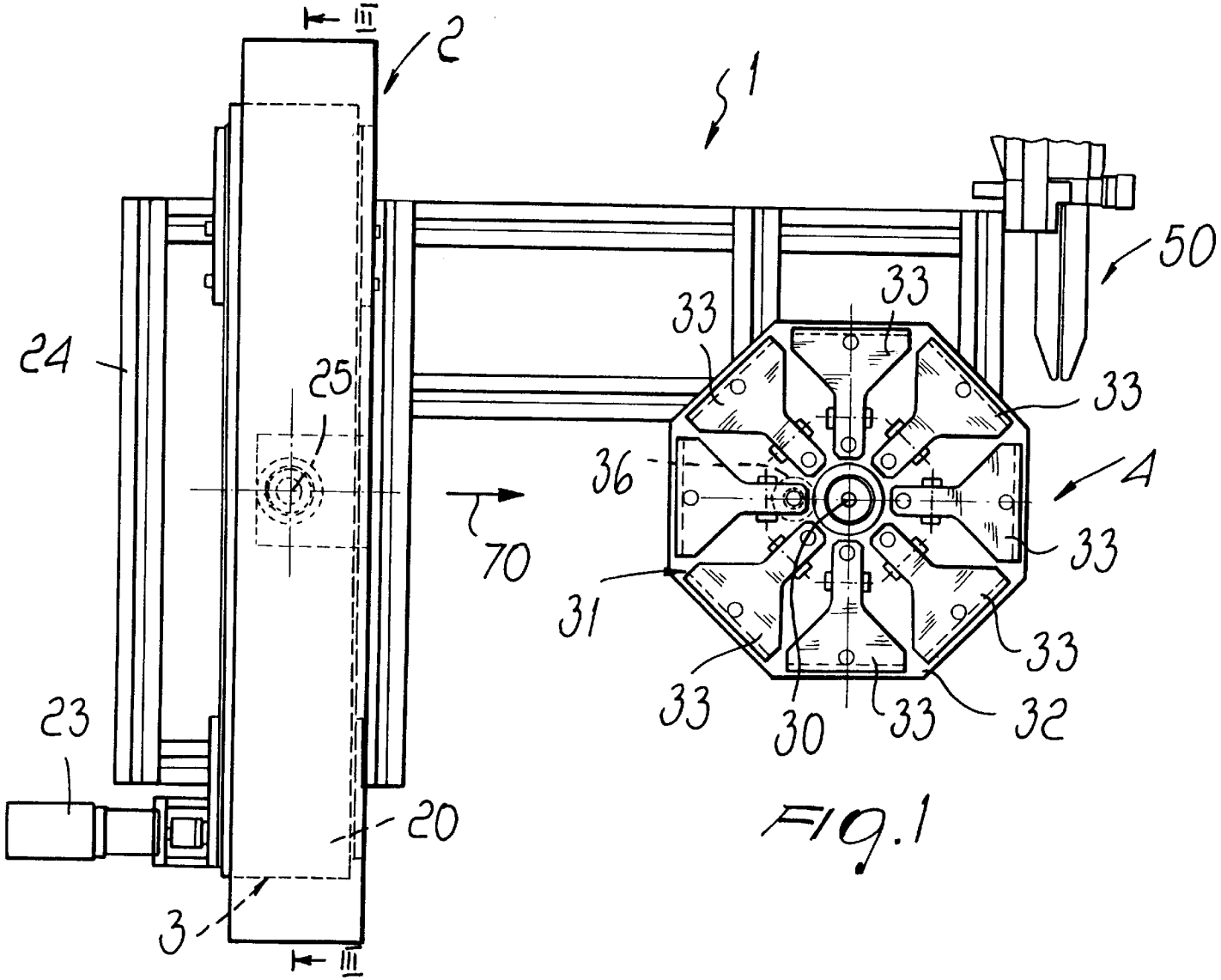
FIG. 1 is a schematic top plan view of the device according to the present invention, in an operating condition.
Figure 2:
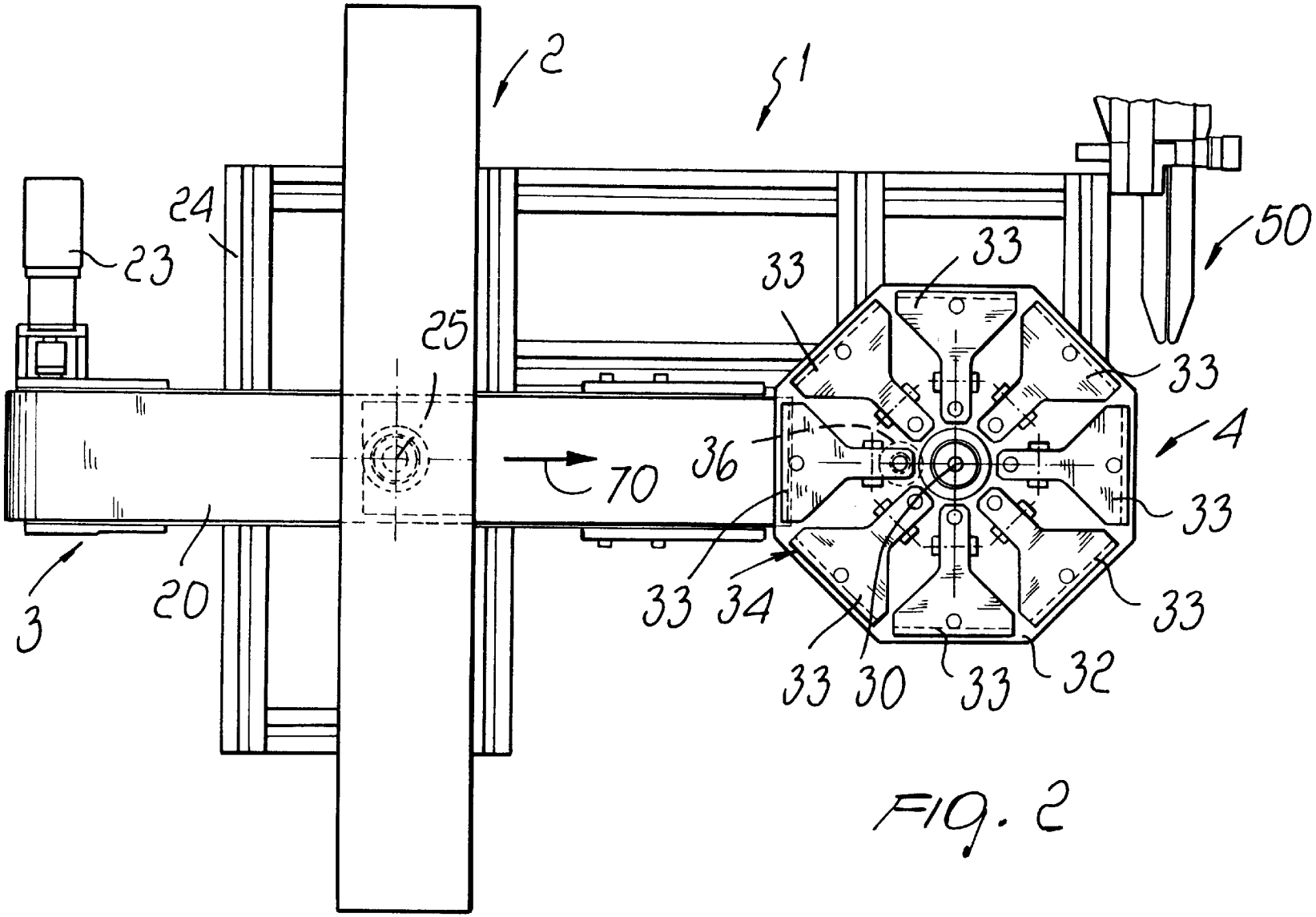
FIG. 2 is a schematic top plan view of the device according to the present invention, in another operating condition.
Figure 3:
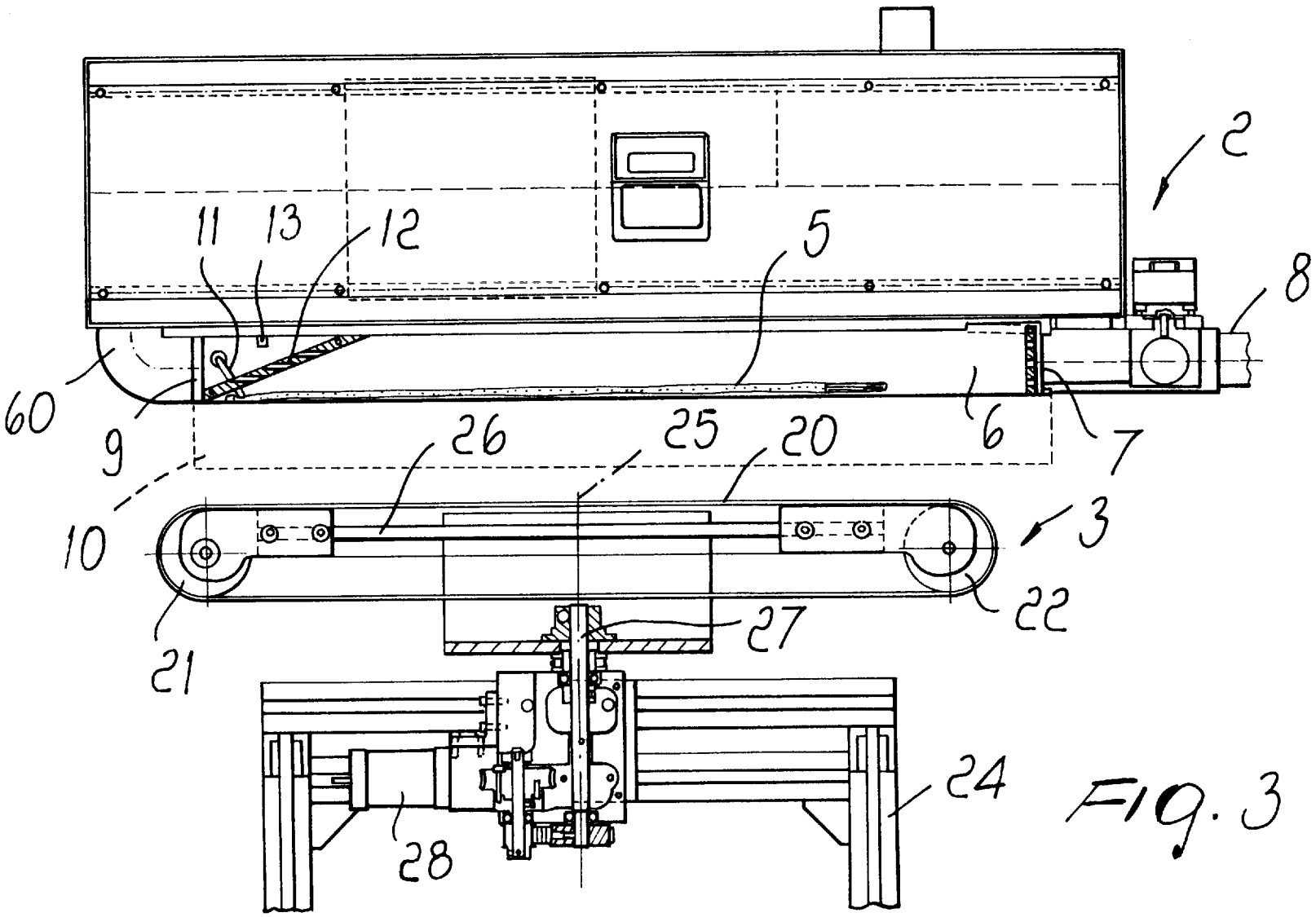
FIG. 3 is a schematic sectional view of FIG. 1, taken along the line III—III.
Figure 4:
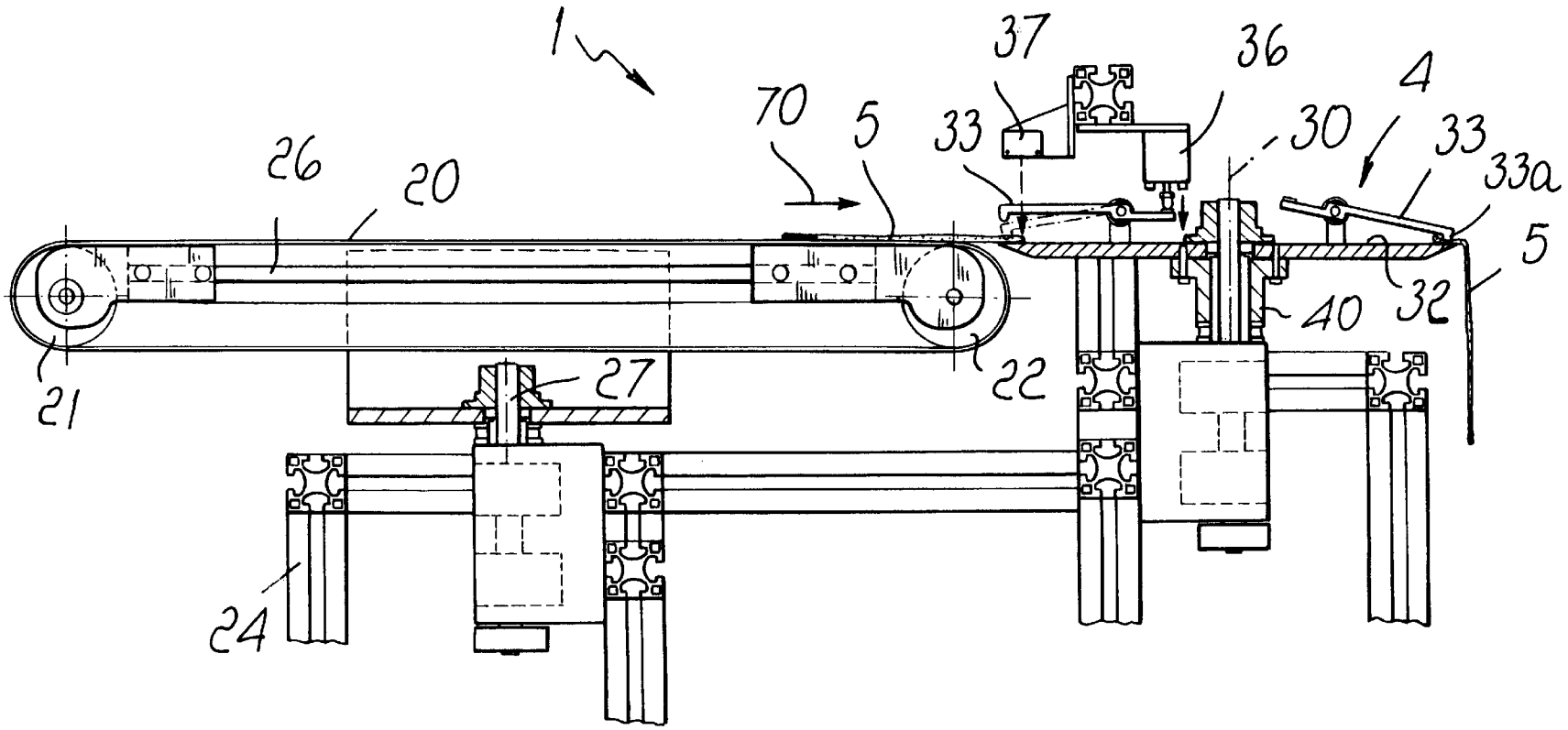
FIG. 4 is a partially sectional lateral elevation view of the device according to the present invention, in the operating condition shown in FIG. 2.
Figure 5:
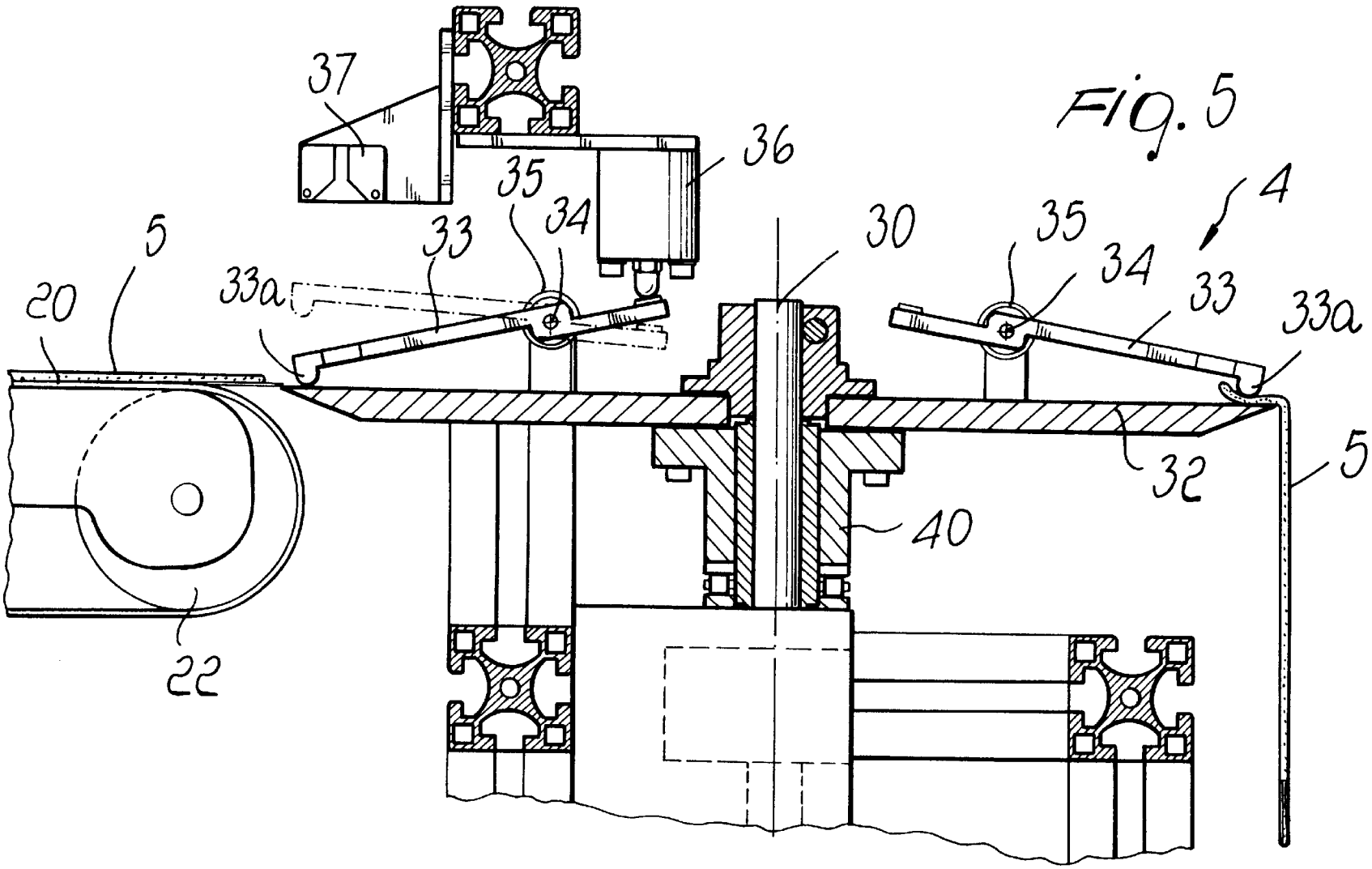
FIG. 5 is an enlarged-scale view of a detail of FIG. 4.

With reference to the figures, the device according to the present invention, generally designated by the reference numeral 1, substantially comprises a laying unit 2, a conveyor 3 arranged below the laying unit 2, and a positioner 4.

The laying unit 2 can be fed with a sock 5 and is adapted to lay out the sock 5 in a substantially horizontal direction.

The laying unit 2 can be constituted by a conventional laying unit, for example the laying unit disclosed in Italian Patent No. 1,293,751.

Said laying unit 2 substantially comprises a laying chamber 6 which has an elongated shape, is arranged so that its longitudinal axis is substantially horizontal, and has, at its longitudinal ends, respectively a first opening 7 which is connected to a delivery duct 8 for the sock 5 to be laid out and a second opening 9 which is connected, by means of a connecting duct 60, to a suction duct which is not shown for the sake of simplicity. The laying chamber 6 is closed in a downward region by a flap 10 which can be opened on command in order to remove by gravity the laid-out sock 5.

In the laying chamber 6, proximate to the second opening 9, grip means 11 are provided which can engage on command a longitudinal end of the sock 5.

Substantially, by connecting the second opening 9 to the suction duct, the sock 5 is sucked into the laying chamber 6 through the duct 8 and reaches, with one of its longitudinal ends, the vicinity of the second opening 9, which is adequately protected by means of a grille 12 which prevents the sock from being sucked through the second opening 9. Then the grip means 11 are actuated so as to clamp said longitudinal end of the sock 5, while the first opening 7 is connected to the suction duct and the second opening 9 is connected to the outside. In this way, the flow of air along the laying chamber 6 is reversed, with the effect of laying out the sock 5 along its entire length, being retained by the grip means 11 at one of its longitudinal ends. The suction inside the chamber 6 is then interrupted so that the sock 5 rests on the flap 10, which is then opened so as to let the correctly laid-out sock 5 fall below.

Inside the laying chamber 6, proximate to the grip means 11, it is possible to provide sensor means 13 for detecting the orientation of the laid-out sock 5, as will become better apparent hereinafter.

The conveyor 3 is preferably constituted by a conveyor belt 20 which winds around two rollers 21 and 22 which have mutually parallel horizontal axes, so that the upper portion of the conveyor belt 20, designed to receive the sock 5 that falls from the laying unit 2, lies on a substantially horizontal plane.

The roller 21 is connected to a gearmotor 23, which can be activated on command so as to produce the advancement of the upper portion of the conveyor belt 20 toward the positioner 4.

If the sock is already orientated correctly, i.e., so that its toe is directed toward the second opening 9, when it reaches the inside of the laying chamber 6, the conveyor belt 20 can be supported in a fixed manner by a supporting structure 24.

Otherwise, i.e., if it is not possible to determine in advance which of the two longitudinal ends of the sock 5 is engaged by the grip means 11 of the laying unit 2, the conveyor belt 20 is conveniently supported by the supporting structure 24 so as to be able to rotate about a vertical axis 25 which is arranged in an intermediate region of the extension of the conveyor belt 20.

More particularly, the frame 26 that supports the rollers 21 and 22, as well as the gearmotor 23, is fixed to the upper end of a shaft 27 whose axis coincides with the axis 25 and which is supported, so that it can rotate about said axis 25, by the supporting structure 24.

The shaft 25 is connected to a motor 28 which is mounted on the supporting structure 24 and can be activated so as to produce the rotation of the frame 26 and therefore of the conveyor belt 20 about the axis 25 over a preset angle, so as to vary the end of the conveyor belt 20 that is directed toward the positioner 4, according to the orientation of the sock 5 inside the laying chamber 6.

The sensor means 13 can be constituted by a photocell or other device capable of recognizing which longitudinal end of the sock 5 is engaged by the grip means 11. For example, it is possible to knit the toe portion of the sock 5 which is designed to be optionally removed during the subsequent darning operation by using a thread of a different color than the remaining part of the sock, or a thread which can in any case be easily detected by a photocell or other sensor system. The sensor means 13 are operatively connected to the motor 28, so as to produce or not the rotation of the conveyor belt 20 about the axis 25 so that the sock 5 always reaches the positioner 4 with its toe.

In the illustrated embodiment, the laying unit 2 is arranged so that the longitudinal axis of the laying chamber 6 is orientated transversely to the advancement direction 70 required to move the sock 5 from the laying unit 2 to the positioner 4.

With this arrangement, when the conveyor belt 20 receives the sock 5 that falls from the laying chamber 6, said belt also is orientated at right angles to the advancement direction 70 required to transfer the sock 5 to the positioner 4.

For this reason, after the sock 5 has fallen onto the conveyor belt 20 the motor 28 is activated so as to turn the conveyor belt 20 about the axis 25 through 90°, so as to direct it with one end toward the positioner 4. Depending on the orientation of the sock 5 detected by the sensor means 13, the conveyor belt 20 is turned in one direction or in the opposite direction, and the motor 23 is activated accordingly so as to convey the sock 5 toward the positioner 4 with the toe of the sock 5 facing forward, i.e., toward the positioner 4.

The laying unit 2 can also be orientated so that the longitudinal axis of the laying chamber 6 is parallel to the advancement direction 70 required to transfer the sock 5 from the laying unit 2 to the positioner 4. In this case, if the sock 5 inside the laying chamber 6 has its toe already directed toward the positioner 4, the conveyor belt 20 is not turned about the axis 25, while if the sock 5 has its toe directed away from the positioner 4 the motor 28 is activated so as to turn the conveyor belt 20 about the axis 25 through an angle of 180° and the motor 23 is activated so as to produce an advancement of the conveyor belt 20 in the opposite direction with respect to the preceding one, so as to still produce the advancement of the sock 5 toward the positioner 4 with its toe directed toward the positioner 4.

As a consequence of this fact, the sock 5 in any case reaches the positioner 4 with its toe.

The positioner 4 comprises a carousel structure which is rotatable about a vertical axis 30 and is provided with a plurality of grip means 31 distributed about the axis 30. The carousel structure can rotate on command intermittently about the axis 30, so as to position in each instance one of the grip means 31 at the delivery end of the conveyor belt 3.

More particularly, the carousel structure of the positioner 4 comprises a disk-like body 32, whose axis coincides with the axis 30; said body lies substantially on the same horizontal plane as the upper portion of the conveyor belt 20.

The grip means 31 comprise pressers which are constituted by paddles 33 which are hinged to the disk 32 with an intermediate portion about an axis 34.

The disk 32 is fixed to the upper end of a shaft 40 which is connected in a per se known manner to a conventional motor, which can be activated so as to produce an intermittent rotation of the disk 32 about the axis 30 through an angle which corresponds to the angular spacing of the paddles 33 about the axis 30, so as to make one of the paddles 33 face, in each instance, the delivery end of the conveyor belt 20.

The paddles 33 can oscillate on command about the axis 34, so that one of their ends 33*a* moves toward or away from the upper face of the disk 32 proximate to the perimetric rim of said disk.

The paddles 33 can oscillate about the axis 34 so that their end 33*a* moves away from the upper face of the disk 32 in contrast with a return spring 35, which tends to retain the end 33*a* against the upper face of the disk 32.

The oscillation of the paddles 33 about the axis 34, in contrast with the action applied by the springs 35, can be achieved by means of a pneumatic cylinder 36 which is supported above the disk 32 and can be activated so as to act on the end of the paddle 33 that lies opposite the end 33*a* when the paddle 33 faces the delivery end of the conveyor belt 20 as a consequence of the rotation of the disk 32 about the axis 30.

Proximate to the delivery end of the conveyor belt 20 there is a sensor 37 for detecting the arrival of the stocking 5, with its toe, on the disk 32. Said sensor 37, which can be constituted by a photocell or other sensing device, is operatively connected to the pneumatic cylinder 36 so that the activation is of the pneumatic cylinder 36 is dependent on the arrival of a sock 5 on the perimetric rim of the disk 32 that faces the delivery end of the conveyor belt 20.

The end 33*a* of the paddles 33 is capable of clamping the toe of the sock 5 that arrives from the conveyor belt 20, and the intermittent rotation of the disk 32 about the axis 30 also produces an arrangement of the sock 5, clamped at its toe by the corresponding paddle 33, on a substantially vertical plane.

The operation of the device according to the present invention is as follows.

The sock 5, which arrives from the duct 8, is laid out inside the laying chamber 6 of the laying unit 2. The conveyor belt 20 is arranged below the laying chamber 6 and parallel thereto.

After the sock 5 has been laid out on a substantially horizontal plane inside the laying chamber 6, the flap 10 is opened so as to allow the sock 5 to fall onto the upper portion of the conveyor belt 20. Depending on the orientation of the sock 5 that is prearranged or detected by the sensor means 13, in the manners explained above, the conveyor belt 20 is actuated so as to produce the advancement of the sock 5 toward the positioner 4 with its toe directed toward the positioner 4.

In the meantime, the paddle 33 of the positioner 4 that faces the delivery end of the conveyor belt 20 has been moved, with its end 33*a*, away from the upper face of the disk 32 by actuating the pneumatic cylinder 36.

When the toe of the sock 5 arrives at the disk 32, i.e., between the upper face of the disk 32 and the end 33*a* of the paddle 33, its presence is detected by the sensor 37, which acts on the pneumatic cylinder 36 so as to interrupt its action on the paddle 33. Due to the action applied by the spring 35, the paddle 33 turns about the axis 34, approaching, with its end 33*a*, the upper face of the disk 32 and therefore clamping the toe of the sock 5.

At this point the disk 32 is turned about the axis 30 in order to make is another paddle 33 face the delivery end of the conveyor belt 20. Due to this rotation, the sock 5, clamped at its toe on the upper face of the disk 32 by the corresponding paddle 33, remains suspended by its toe and arranged on a vertical plane, falling laterally off the disk 32 with the remaining part of its body.

At this point the conveyor belt 20, after being optionally turned about the axis 25, is ready to receive a new sock 5 from the laying unit 2 and convey it toward the positioner 4 so that it is clamped by another paddle 33.

The socks 5, hanging at their toe, are correctly positioned and orientated and can be easily gripped by an operator who feeds them to the darning or looping machine 50. This operation is particularly fast and easy because of the fact that the operator is provided with a sock which is already correctly orientated and positioned.

It should be observed that the operation for loading the sock 5 onto the machine that must close its toe, particularly if it is a darning machine, can also be performed mechanically thanks to the fact that the sock is already positioned correctly for feeding to the darning machine.

In practice it has been observed that the device according to the present invention fully achieves the intended aim and objects, since it allows to provide a processing station, which can be controlled manually or mechanically, with a sock which is correctly orientated and ready to be fed to a darning or looping machine, thus reducing the time required to load said darning or looping machine.

The device thus conceived is susceptible of numerous modifications and variations, all of which are within the scope of the appended claims; all the details may further be replaced with other technically equivalent elements. In practice, the materials employed, as well as the dimensions, may be any according to requirements and to the state of the art.

The disclosures in Italian Patent Application No. MI99A001410 from which this application claims priority are incorporated herein by reference.

What is claimed is:

1. A device for feeding correctly orientated socks to a processing station, comprising: a laying unit, feedable with a sock and operatable to lay out the sock in a substantially horizontal direction; a conveyor, arranged below said laying unit and forming a substantially horizontal resting surface for receiving said sock that falls from said laying unit after being laid out in a correct orientation, said conveyor being actuatable to produce advancement of the sock received from said lying unit in an advancement direction which is parallel to a longitudinal extension of the sock, with a toe thereof directed in the advancement direction; and a positioner located along said advancement direction and being provided with gripping means for gripping the sock at the toe as it arrives from said conveyor, said positioner being actuatable so as to arrange the sock to hang vertically at the toe thereof.

2. The device of claim 1, wherein said laying unit has, in a downward region, a door which is openable to allow the sock, after being laid out, to fall onto said conveyor.

3. The device of claim 2, wherein said conveyor is rotatable on command, in a plane of arrangement, in order to locate an end thereof that faces said positioner in different, selected positions, and wherein said conveyor is further actuatable in two mutually opposite conveying directions.

4. The device of claim 3, further comprising actuating means for actuating said conveyors, said laying unit being provided with sensor means for detecting orientation of the laid-out sock, said sensor means being operatively connected to said actuating means for actuating said conveyor, in order to produce rotation thereof on its plane of arrangement and in order to vary and maintain, when necessary, the conveying direction so as to feed the sock to said positioner with the toe directed toward said positioner.

5. The device of claim 4, comprising a supporting structure, said conveyor being constituted by a conveyor belt, said conveyor belt including an upper portion, adapted to receive the sock, upon falling thereof from said laying unit, with said upper portion lying on a horizontal plane; said conveyor belt being further mounted on said supporting structure and being rotatable, on command, with respect to said supporting structure, about a vertical axis located in an intermediate region along an extension of said conveyor belt.

6. The device of claim 4, wherein said positioner comprises a carousel structure which is rotatable about a vertical axis thereof, said carousel structure being provided with a plurality of sock grip means, distributed about said vertical axis of said carousel structure; and wherein said carousel structure is rotatable, on command, with an intermittent motion, about said vertical axis thereof in order to arrange, in each instance, one of said grip means at the delivery end of said conveyor.

7. The device of claim 6, wherein said carousel structure comprises a disk-like body having a disk axis which coincides with said vertical axis of the carousel structure, said disck-like body lying substantially on a same plane as said upper portion of said conveyor belt; said grip means comprising presser elements which are applied to the upper face of said disk, said presser elements being individually actuatable, in order to clamp the toe of the sock that arrives from said conveyor belt onto an upper face of said disk-like body.

8. The device of claim 7, wherein said presser elements are arranged so that a portion thereof that engages the toe of the sock, lies proximate to a perimeter line of said disk-like body, in order to let a remaining part of the sock fall vertically laterally to said disk.

9. The device of claim 8, comprising: presser actuation means proximate to the region where the socks supported by said conveyor belt are delivered onto said disk-like body, a sensor element for detecting arrival of the sock; said sensor element being operatively connected to said presser actuation means for actuating said presser elements for engagement thereof, in each instance, with a sock that arrives onto said disk-like body.

* * * * *